US007971762B2

(12) United States Patent
Clifton, Jr.

(10) Patent No.: US 7,971,762 B2
(45) Date of Patent: Jul. 5, 2011

(54) CARRIER FOR SUPPORTING IMPLEMENTS ON BELTS OF VARYING WIDTHS

(75) Inventor: Norman E. Clifton, Jr., Jacksonville, FL (US)

(73) Assignee: Prezine, LLC, Jacksonville, FL (US)

( * ) Notice: Subject to any disclaimer, the term of this patent is extended or adjusted under 35 U.S.C. 154(b) by 0 days.

(21) Appl. No.: 12/220,099

(22) Filed: Jul. 23, 2008

(65) Prior Publication Data

US 2008/0313861 A1 Dec. 25, 2008

Related U.S. Application Data

(63) Continuation of application No. 11/400,483, filed on Mar. 28, 2006, now Pat. No. 7,657,977.

(51) Int. Cl.
*F41C 33/02* (2006.01)
*F41C 33/00* (2006.01)
*A45F 5/00* (2006.01)

(52) U.S. Cl. ..... 224/197; 224/198; 224/200; 224/660; 224/663; 224/666; 224/667

(58) Field of Classification Search ..... 224/197–200, 224/251, 660, 663, 666, 667, 671
See application file for complete search history.

(56) References Cited

U.S. PATENT DOCUMENTS 2,917,213 A * 12/1959 Bucheimer et al. ..... 224/243
3,589,574 A * 6/1971 Marburger ..... 224/672
4,154,382 A * 5/1979 Blackburn ..... 224/445
4,387,489 A 6/1983 Dudek
5,056,696 A * 10/1991 Lahr ..... 224/148.4
5,222,132 A * 6/1993 Rioux, Jr. ..... 379/455
5,235,728 A * 8/1993 Nordberg ..... 24/3.11
5,730,348 A * 3/1998 Tien ..... 224/669
6,145,169 A 11/2000 Terzuola et al.
6,588,639 B2 * 7/2003 Beletsky et al. ..... 224/672
7,320,420 B2 * 1/2008 Buis et al. ..... 224/197
2003/0085244 A1 * 5/2003 Parsons ..... 224/197
2003/0205594 A1 11/2003 Rassias

OTHER PUBLICATIONS

RRB Systems International Belt Attachment On Sale Aug. 1997.

* cited by examiner

*Primary Examiner* — Justin M Larson
*Assistant Examiner* — Adam Waggenspack
(74) *Attorney, Agent, or Firm* — Arthur G. Yeager

(57) ABSTRACT

A belt clamp with a pivotal article carrier attached thereto includes a base and a cover hinged together at the top. The cover includes a passageway at the lower end to accept a barb-like fastener integral with lower end of base to lock clamp closed. A tongue projects inwardly from the cover to contact and inhibit movement of a duty belt inside the clamp. The base includes a pair of intersecting arcuate slots and a reversible insert having one arcuate slot to make the clamp usable by either right- or left-handed users. A movable belt width adjustment bar is mounted inside the clamp to accommodate belts of various widths. Bosses around the lower opening of the cover inhibit twisting of locked clamp to prevent inadvertent opening. A locking plate is provided to inhibit rotation of fasteners used in pivotal mounting of an article carrier to the belt clamp.

12 Claims, 9 Drawing Sheets

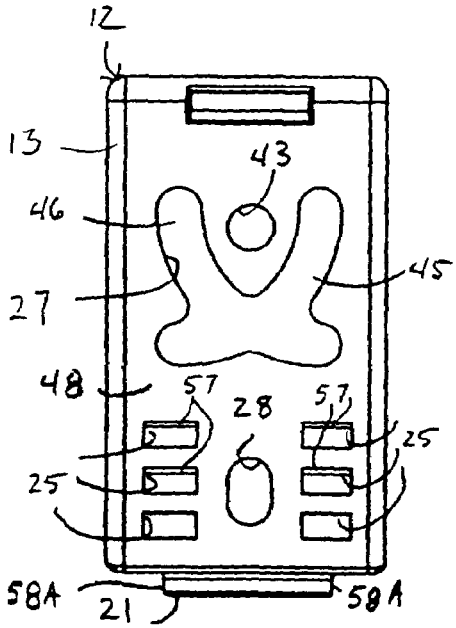
FIG 9
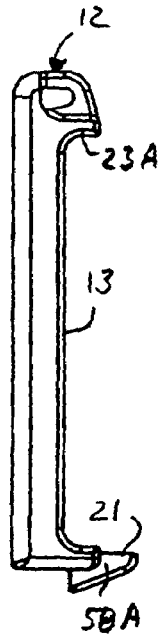
FIG 10
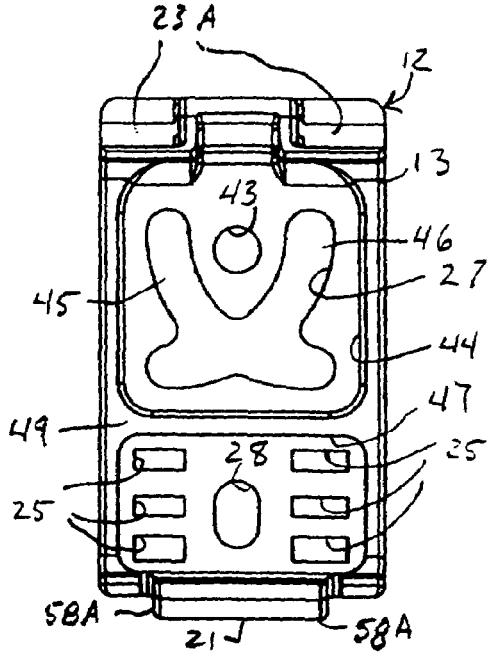
FIG 11
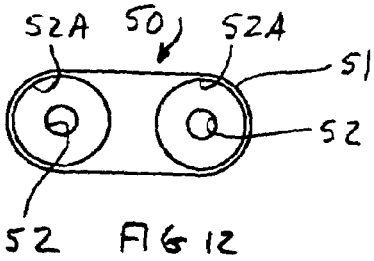
FIG 12
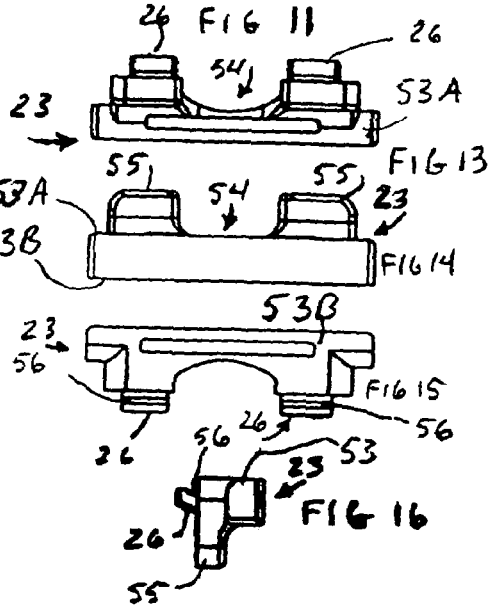
FIG 13
FIG 14
FIG 15
FIG 16

CARRIER FOR SUPPORTING IMPLEMENTS ON BELTS OF VARYING WIDTHS

CROSS-REFERENCE TO RELATED APPLICATION

This application is a continuation and claims priority to application Ser. No. 11/400,483, filed on Mar. 28, 2006 now U.S. Pat. No. 7,657,977.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to attachments to a belt worn by, for example, a policeman for purposes of supporting a gun holster and carrying apparatus for a nightstick and particularly such devices that provide both a swivel adjustment of the position of the attachment as well as a fixed angled position of the attachment and a device carried thereon.

2. Relevant Art

Attachment to a belt for carrying holsters used for guns and nightsticks are well known in the art. Many of the devices currently known are deficient in many respects. Some devices allow position movement only in spaced increments rather than a continuous arc that may be secured at any point. Other devices have a pivot point that may be tightened down to hold the device at selected angles of orientation. What is desired in the art is a device that allows for continuous positioning through a wide arc as well as a multi-point fixed position that is more secure than a single tightened pivot can be. The preferred device should include means to increase or decrease the pivotal resistance of the device as desired. Much of the prior art is deficient in these respects.

Furthermore, prior art devices are not ambidextrous. That is, they are specific to a right-hand or left-hand user. In addition, it is desired that the device be easy to add or remove from a belt and easy to adjust to fit a wide variety of belt widths. Moreover, a tension member should be included to reduce slippage or movement on thin duty belts and a locking capability to reduce the possibility of being bumped or snatched off a belt. The pivot tension is not adjustable because the pivot area is determined by the height of the two metal bushings that the screwheads bottom out on. Finally, the members of the clamp, particularly the cover, should be formed in a manner to inhibit twisting of the members, which could lead to inadvertent opening of the clamp when in use.

Relevant art includes U.S. Pat. No. 6,145,169 to Terzuola, et al., and a brief description (including drawings) of a device previously made and sold by the present applicant.

BRIEF SUMMARY OF THE INVENTION

In one aspect of the present invention there is provided a belt clamp adapted for attachment to a belt encircling a waist of a user for carrying an article comprising a base member adapted for attachment of an article having an inside and outside surface and an upper and lower portion including a locking portion; a cover member having an inside and outside surface and an upper and a lower portion including a locking portion for engaging the locking portion of the base member; cooperating fasteners between the upper portions of respective members for movement of the members between a closed position defining an interior space between the inside surface of the members and an open position; cooperating locking members including a locking passageway in one lower portion of one member, and a projecting element on another lower portion of other member disposable within the passageway to releasably lock the members together, the projecting element sized to substantially occupy the passageway to be nested therein for inhibiting twisting movement between the base and cover members to maintain the locking members in the closed position.

Other features include a belt-tensioning element for inhibiting inadvertent movement of the belt clamp on a belt, the belt-tensioning element including a blade connected to one member projecting inwardly into the interior space for contacting a surface of a belt locatable therein. The blade is formed integrally with the cover member. A plurality of vertically spaced slots is formed in the lower portion of one member for carrying a belt width adjustment bar located in the interior space, the bar being selectively positionable into one of the vertically spaced slots for varying the vertical distance between the bar and the upper portion of one member to adjust the clamp to various widths of a belt disposable within the space. The belt width adjustment bar is disposed in the interior space and a pair of laterally projecting spaced prongs are positionable in a vertically selected pair of spaced slots for varying the vertical distance between the adjustment bar and the upper portion of one member. There is a pair of spaced upper flanges projecting inwardly from the upper portion of one member for contacting an upper edge of a belt positioned in the interior space.

The base member includes a pair of substantially identical arcuate slots each having opposite terminal ends, a pivot opening is adjacent the slots, a spacer has a pair of spaced openings therethrough, and a pair of fasteners for attaching the spacer to the base member, one fastener passing through one slot and one opening in the spacer, another fastener passing through the pivot opening and another opening of the spacer for selective pivoting and securing of the spacer to the base member at a desired location. Also included is a pivot plate having first and second sides sized to fit superimposed over the arcuate slots and the pivot opening and against the inside surface of the base member, the pivot plate including an arcuate slot substantially identical to each arcuate slot in the base member and at least one opening, the at least one opening is located to be superimposed over the pivot opening of the base member, the arcuate slot of the pivot plate being aligned over one arcuate slot of the base member when the first side is positioned against the inside surface of the base member, the arcuate slot of the pivot plate being aligned over another arcuate slot of the member when the second side is against the inside surface of the base member so that the clamp may be worn on the left or right side of a user.

One locking portion includes a locking opening having a lower lip and terminal ends, the other locking portion includes a projecting member having a barb for engaging with the lip when the other locking portion is located within and substantially occupying the locking passageway, the barb including an undercut ledge inclined from the vertical for contacting the lip of the locking passageway. The locking passageway is elongated and oriented transversely of one locking portion, the barb having end walls positionable closely adjacent the terminal ends of the locking passageway.

In another aspect of the present invention there is provided a belt clamp adapted for attachment to a belt encircling a waist of a user for carrying an article comprising a base member adapted for attachment of an article having an inside and outside surface and an upper portion having a flange portion projecting from the inside surface and lower portion, the lower portion including a locking portion; a cover member having an inside and outside surface and an upper and a lower portion, the lower portion of the cover member including a locking portion for engaging the locking portion of the base member, hinge means connected between the upper portions of respective members for pivotal movement of the members between a closed position defining an interior space between the members and an open position, and a tongue connected to one member and projecting in the interior space for contacting a surface of a belt locatable therein to inhibit movement of the clamp on a belt.

The locking portions including cooperative locking members having a locking passageway on one lower portion of the base and cover members are included, and a projecting element on another lower portion of the base and cover members disposed within the passageway to releasably lock the members together, the projecting element having a predetermined length substantially equal to a length of the passageway to inhibit twisting movement between the base and cover members to maintain the locking members in the closed position. One locking portion includes a locking opening having a lower lip and terminal ends, the other locking portion includes a projecting member having a barb for engaging with the lip when the other locking portion is located within and nested within the locking opening. The base member includes a pair of spaced rows of openings, each row includes a plurality of vertically disposed screw openings, a pivot opening adjacent the rows, a spacer having a pair of spaced openings therethrough, and a pair of screws having head portions for attaching the spacer to the base member, one screw passing through one opening in one row and one opening in the spacer, another screw passing through the pivot opening and another opening in one row to allow for selective rotation of the spacer on the base member to a desired location. Each row of openings is arranged in an arcuate manner to provide for selective locating of the spacer on the base member. The base member further includes a vertical elongated screw opening to provide for the use of a third screw for attaching the base member to an article to be attached to the belt clamp.

In a further aspect of the invention there is provided a belt clamp adapted for attachment to a belt encircling a waist of a user for carrying an article comprising a base member adapted for attachment of an article thereto having an inside and outside surface and an upper and lower portion; a cover member having an inside and outside surface and an upper portion and a lower portion releasably engagable with the lower portion of the base member; cooperating fasteners attached between the upper portions of respective members for movement of the members between a closed position defining an interior space between the inside surface of the members and an open position; cooperating locking members including a locking passageway in one lower portion of one member, and a projecting element on another lower portion of other member disposable within the passageway to releasably lock the members together, the projecting element nested in the passageway for inhibiting twisting movement between the base and cover members to maintain the locking members in the closed member.

A fastener locking plate having a body and a pair of spaced fastener openings therethrough is included. Such locking plate is locatable between the head portions of the fasteners and the inside surface of the base member for providing a consistent adjustable tension distribution between the base member, and the spacer and insert plate, if either is used. Recesses are formed around the openings to accommodate the heads of the fasteners used.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 9 is an outer surface view of the inside base of the belt clamp of FIG. 1;

FIG. 10 is a side view of the base of FIG. 9;

FIG. 11 is an inner surface view of the base of FIGS. 9-10;

FIG. 12 is a plan view of the screw plate in accord with the present invention used with the belt clamp of FIG. 1;

FIG. 13 is a top surface view of the width adjustment flange in accord with the present invention used in the belt clamp of FIG. 1;

FIG. 14 is a rear view of the flange of FIG. 13;

FIG. 15 is a bottom surface view of the flange of FIG. 13;

FIG. 16 is an end elevation view of the flange of FIG. 13;

DETAILED DESCRIPTION OF THE INVENTION

Figure 2:
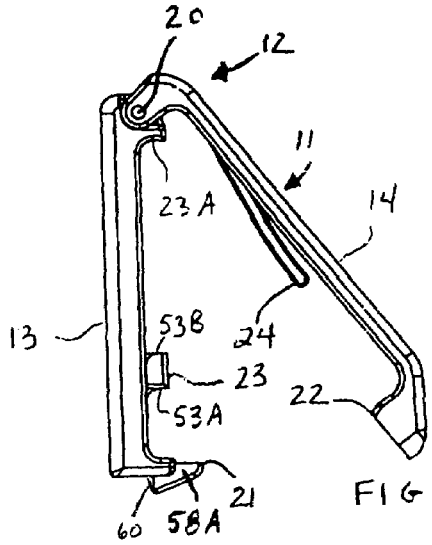
FIG. 2 is a side elevation view of the belt clamp of FIG. 1.
Figure 4:
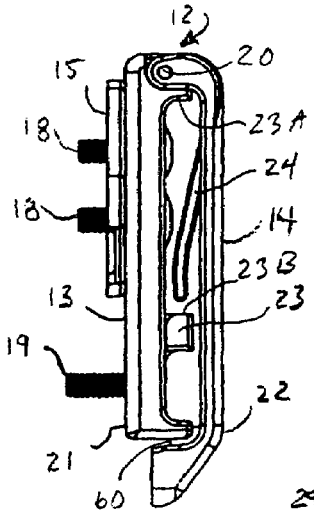
FIG. 4 is a side view of the belt clamp and carrier of FIG. 1.
Figure 1:
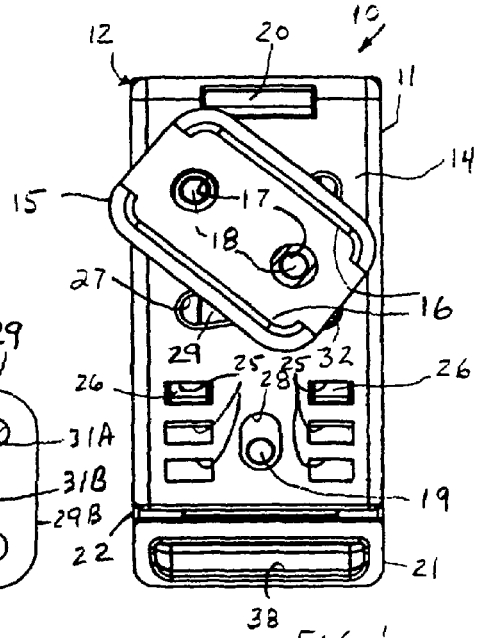
FIG. 1 is an elevation view of the belt clamp and carrier according to the present invention.
Figure 7:
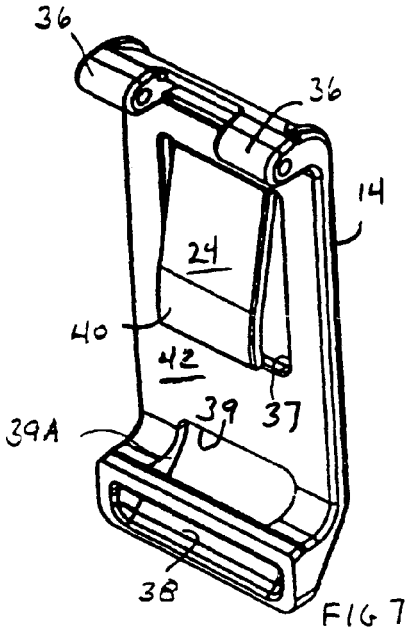
FIGS. 7-8 are perspective views of the cover of FIG. 5.
Figure 6:
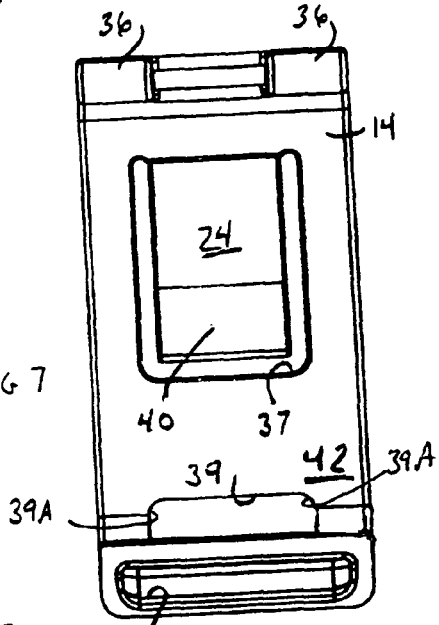
FIG. 6 is an inner surface view of the cover of FIG. 5.
Figure 5:
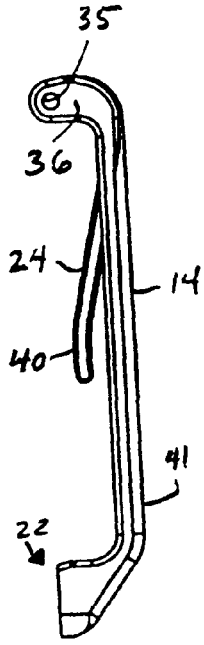
FIG. 5 is a side view of the outside cover of the belt clamp in accord with the present invention.
Figure 8:
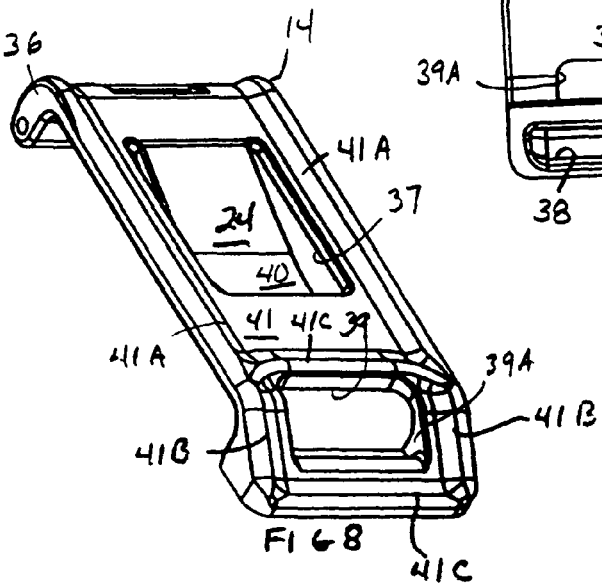

With respect now to the drawings, the belt clamp and carrier in accord with the present invention is shown in FIGS. 1 and 4 at numeral 10. In FIG. 2 the basic belt clamp frame 11 is illustrated showing the belt clamp in an open position.

The belt clamp 11 consists of two members: a base member 13 and a cover member or clamp plate 14 pivotally connected via cooperating fasteners in the form of a pin hinge shown generally at 12. Spacer member 15 (FIG. 1 used with T-nuts is mounted to base 13 via openings 17 and fasteners such as screws 18 and includes a pair of spaced parallel ribs 16 that enhance the engagement of spacer 15 with attachment apparatus, especially with a carried device having a curved outer surface. If the curved device is flat, spacer 15 need not be used. A lower elongate fastener such as screw 19 can be used to attach base 13 to a carried device if desired and in a fixed position.

The base 13 is secured to cover 14 via lower locking portions 21 and 22, respectively that provide a snap lock as will be described in more detail hereinbelow.

Belt tensioning member 24 is formed in cover 14 and rests against a duty belt when the clamp 10 is in a closed position (FIG. 4). A belt width adjustment flange or bar 23 is movable vertically to accommodate belts of different widths between upper spaced flanges 23A and 23 as will be further discussed hereinbelow.

FIG. 1 illustrates three spaced pairs of width adjustment slots 25 forming passageways. The adjustment bar or flange 23 includes a pair of spaced prongs 26 that are installed in one of a plurality of pairs of spaced vertically arranged slots 25. Spacer 15 is mounted to base 13 via screws 18 and is pivotal via an arcuate slot opening 27 as will be discussed in more detail hereinbelow. A distance compensating elongate opening 28 is provided with a screw 19 for various mounting arrangements, as will be discussed in more detail hereinbelow. A distance arrangements, as will be more apparent hereinafter (being merely illustrative in FIG. 1).

Figure 3:
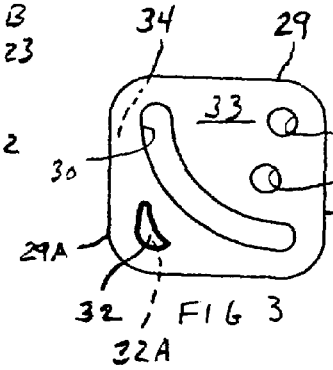
FIG. 3 is a plan view of the pivot plate insert in accord with the present invention used in the belt clamp of FIG. 1.

As will be discussed in more detail hereinbelow, a reversible pivot or rotation plate formed as insert 29 is shown in FIG. 3 with bottom edge portion 29A and top edge portion 29B. An arcuate slot 30 provides for rotating the position of the spacer 15 through approximately 90° to a desired location. Two fastener axis openings 31A and 31B are also provided. Bosses 32, 32A are provided on opposite sides 33, 34 to locate the plate to the inside of base 14. One side 33 is the same as the other side 34. Depending upon which side is against the base 14, the slot 30 will be oriented in a direction that accommodates right or left rotation of a spacer 15 for a right-handed or left-handed user as desired, particularly for a holster. For example, in FIG. 1, plate 29 is provided such that side 34 fits against base 14. One screw 18 fits through opening 31A and another screw 18 fits into arcuate slot 30 at the desired location to rotate and then secure spacer 15 at the desired position. The two-point attachment is more secure than one-point attachments. A further example of the capability of the present belt clamp derives from the reversible nature of plate insert 29. A right-hand user who may want the holster device to pivot the opposite direction—such as that of a left-handed user—need only to reverse the plate insert 29 rather than using a non-ambidextrous device.

With respect to FIGS. 5-8, the details of clamp cover 14 are illustrated. Belt tensioning member 24 is formed as an inwardly projecting tongue or blade element with slot 37 around it and fits closely adjacent base 13 and includes a lower arcuate portion 40 that contacts and pushes against a duty belt to minimize movement of the clamp. The remainder of inner surface 42 of cover 14 is substantially planar with a smooth matte finish. Pin 20, spaced hinge flanges 36 and hinge pin holes 35 (FIG. 1) are conventional as understood in the art.

Outer surface 41 of cover 14 includes formed bosses 41A, 41B and 41C that reinforce cover 14 adjacent opening 37 and locking opening 39 to inhibit any twisting of the cover 14 during use that may cause the clamp 10 to become inadvertently unlocked. Transverse slot 38 (FIGS. 6 and 7) also provides rigidity and resistance to twisting.

FIGS. 9-11 illustrate base 13. Carrier adjustment slot opening 27 includes two functionally distinct intersecting arcuate slot portions 45, 46. Pivot plate opening 32 fits in alignment with pivot screw opening 43 into recess 44. In use, openings 30, 31A, 31B and 43 can be used in any appropriate pivotal or fixed combination as required in the circumstances. In addition, pivot plate 29 can be omitted if not needed when the device is used in a fixed mounting configuration. Locking plate 50 (FIG. 12) includes body 51 and two fastener openings 52 surrounded by recesses 52A that may accommodate T-bushings (not shown) if desired. Locking plate 50 provides an intermediate part of the pivot system. Plate 50 eliminates the likelihood that fasteners, preferably in the form of threaded screws 18, will be loosened due to repeated pivot action of spacer 15. The plate 50 also provides a larger bearing surface that applies a consistent adjustable tension distribution between the lower surface of spacer 15, the outer surface of spacer 15, the outer surface of base 13, and a surface 33, 34 of plate insert 29 as screws 18 are tightened to provide the desired pivotal resistance to movement. If plate insert 29 is not used, locking plate 29 rests against inside surface 48 of base 13.

Figure 18:
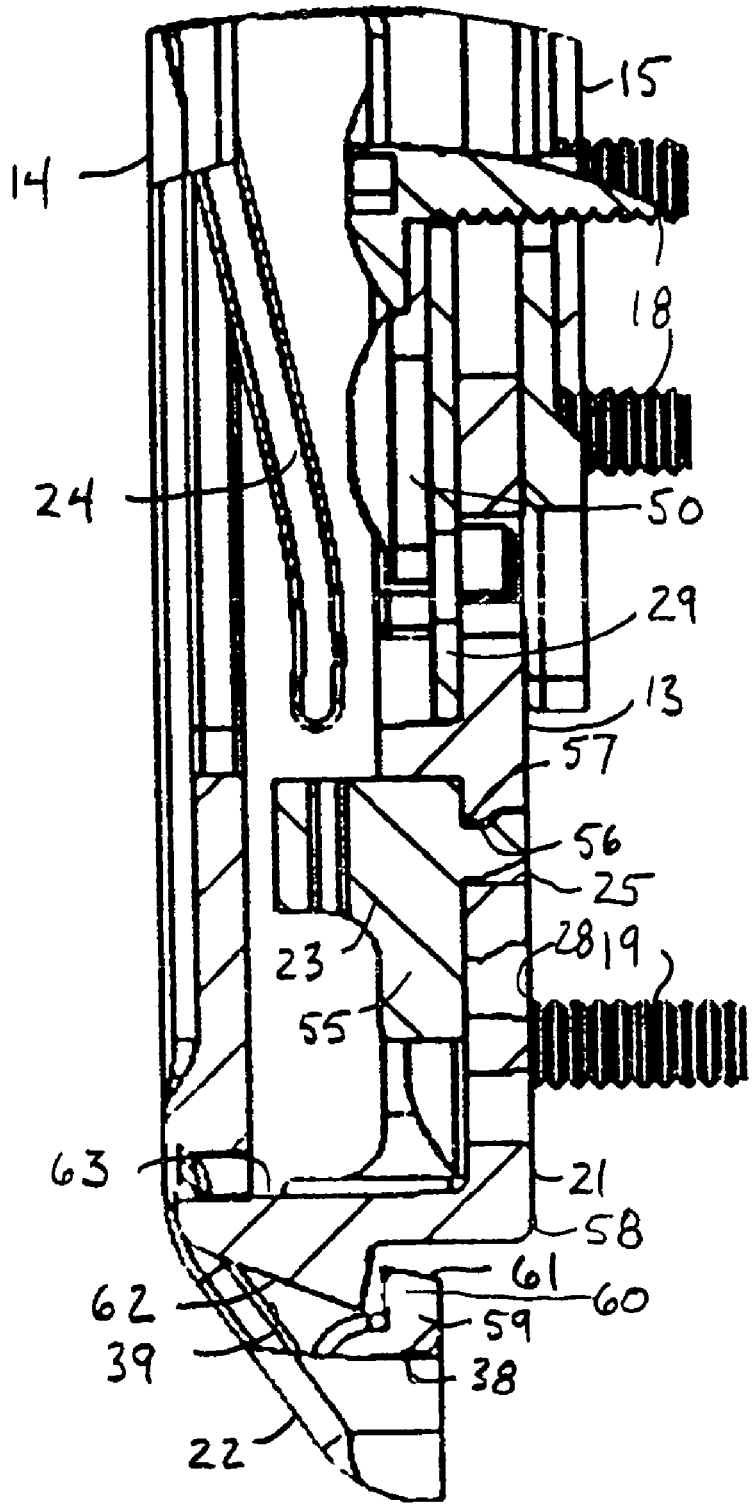
FIG. 18 is an enlarged partial view of the drawing of FIG. 17.
Figure 19:
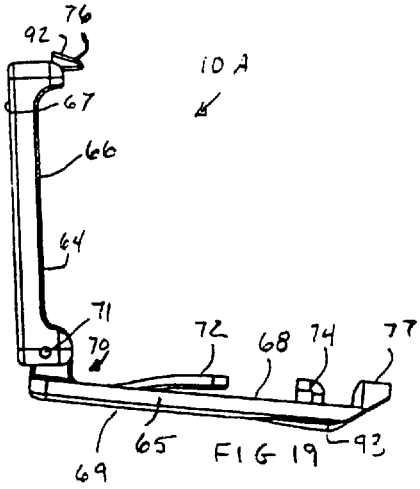
FIG. 19 is a side view of a second embodiment of the belt clamp in accord with the present invention in the open position.
Figure 20:
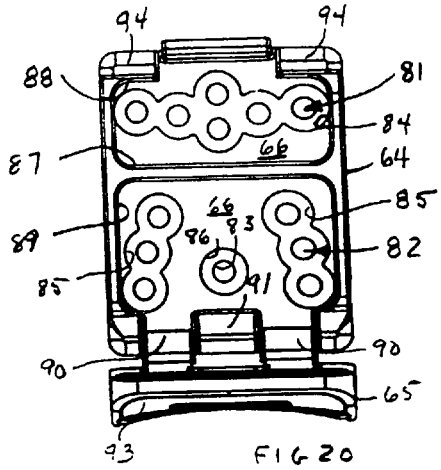
FIG. 20 is an elevational view of the belt clamp of FIG. 19.
Figure 21:
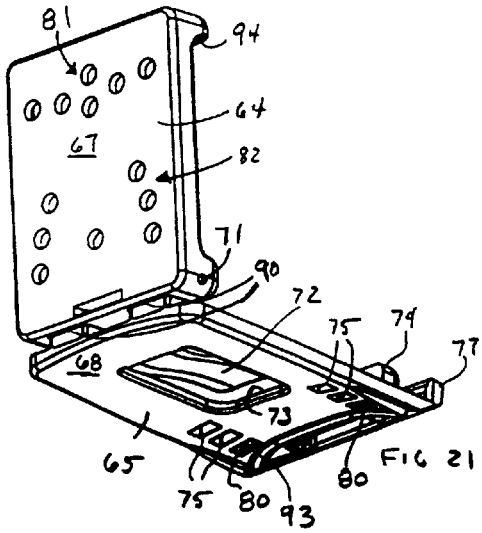
FIG. 21 is an outside perspective view of the belt clamp of FIGS. 19-20.

Belt width adjustment flange 23 has each prong or tab 26 dimensioned to fit into selected slots 25 set in recess 47 and is illustrated in FIGS. 13-16. As can be seen from FIGS. 11 and 13-16, the prongs 26 fit within selected pairs of horizontally aligned slots 25. Flange 23 is a unitary element with a pair of spaced projecting prongs or tabs 26. The space 54 between prongs 26 is sized to allow for passage for screw 19. Prongs 26 extend from spaced bosses 55. The upper portion of each prong 26 includes a groove 56 that is engaged via lip 57 of slot 25 (FIG. 18). Sides 53A and 53B provide a resting surface for the lower edge of a belt.

The belt width adjustment works as follows (FIGS. 9-16). Flange 23 can be inserted into the uppermost or first pair of spaced slots 25 for belts of 1½-inch width. The next lower or second pair (¼ inch below first) provides for 1¾ inches. The lower or third pair (¼ inch below second) allows for a 2-inch belt. The elimination of the flange 23 allows for a 2¼-inch belt.

Figure 17:
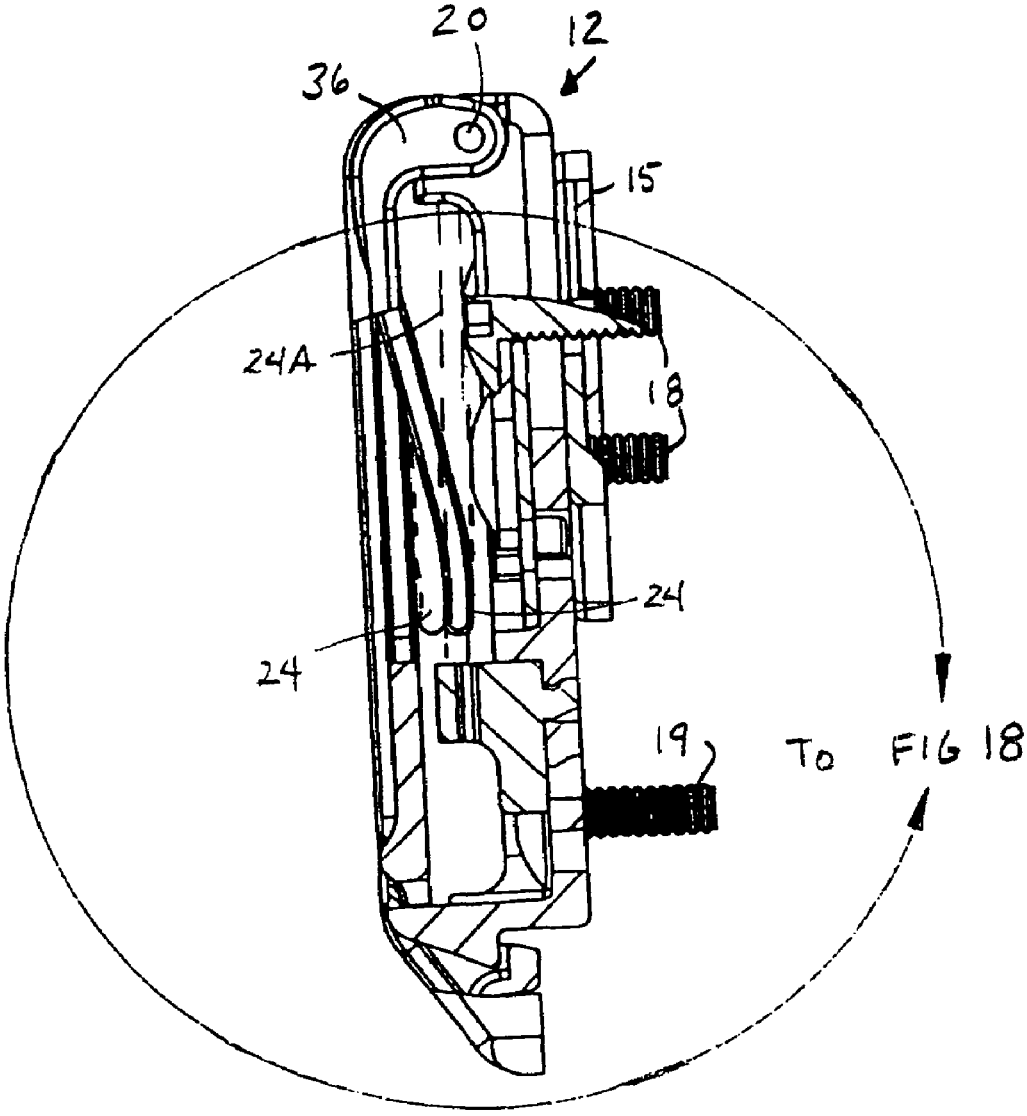
FIG. 17 is a side view of the belt clamp and carrier of FIG. 1 including a partial cross-sectional view.

FIGS. 17 and 18 illustrate the locking apparatus of the clamp 10. The lower portion 21 of base 13 includes a single medially-located fastener 58 formed of an inwardly directed projecting member 63 having a lower barb portion 62 with ledge 60 slightly inclined by 2-3° from the vertical (FIG. 18) that fits within locking opening 39. When the locking portions 21, 22 are snap-fitted, fastener 58 will be nested or caged by opening 39. The end walls 58A of fastener 58 fit very closely adjacent the respective interior terminal ends 39A of elongate opening or passageway 39. There is accordingly virtually no "play" between fastener 58 and opening 39, which greatly inhibits inadvertent opening of the clamp 10 due to any twisting forces placed on the clamp 10 in use. This structure cooperates with bosses 41A, 41B and 41C. When clamp 10 is closed, tension element 24 is pushed to the position shown in broken line by belt 24A (shown in broken line).

The slightly inclined-from-vertical undercut portion 60 provides for easier manual opening of the clamp 10 by thumb pressure on fastener 58 than would otherwise be the case.

The locking portion 22 of cover 14 includes a fastener 59. The locking portion 21 of base 13 includes a fastener 58. The bottom of elongate locking opening 39 oriented transversely of base 13 is formed as a lip or ledge 61 and is resilient enough to provide that member 63 of fastener 58 provides a snap fit into the opening 39 to secure the fasteners 58, 59 together as shown in FIGS. 17, 18. The clamp 10 may be opened by placing a finger against sloping portion 62 of fastener 58 and pulling cover 14 at its lower portion 22. The cooperating locking portions 21, 22 have sufficient resiliency to allow for easy opening but only via the specific opening action described.

FIGS. 19-23 illustrate a second embodiment of the belt clamp 10A including a base 64 and cover 65. Base 64 includes inner and outer surfaces 66, 67. Base 65 includes inner and outer surfaces 68, 69. Hinge 70 and hinge pin 71 are substantially as before.

This embodiment of the belt clamp is designed to accommodate the largest possible number of carried devices. In order to accomplish this objective, the belt width adjustment apparatus including bar 74 and slots 75 is now on the cover 65. Belt tensioning member 72 is in the form of a projecting blade element and slot 73 is substantially as before, as are locking portions 76, 77. Locking slot 79 is surrounded by bosses 93 to reinforce the locking portion 77 to inhibit twisting as before. Transverse slot 78 also serves the same purpose as before.

Figure 22:
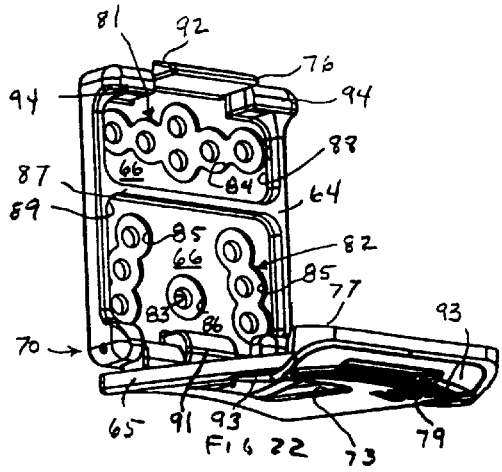
FIG. 22 is an inside view of the belt clamp of FIGS. 19-21.
Figure 23:
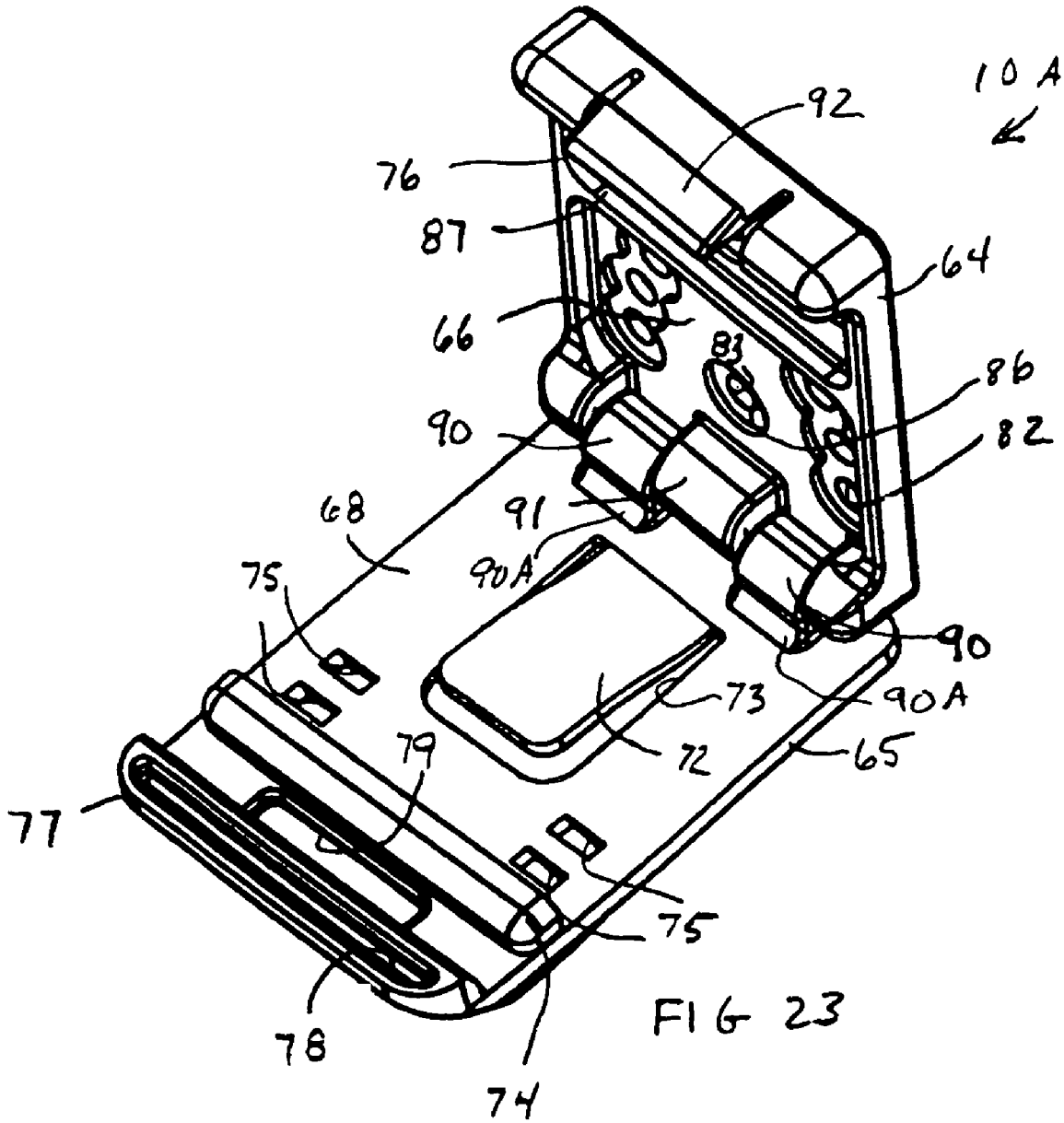
FIG. 23 is another inside view of the belt clamp of FIGS. 19-22.

The inside surface 66 of base 64 includes a molded recess 84 around a first group of openings 81 in recess 88. A second group of openings 82 each have a molded recess 85 in larger recess 89 separated by rib 87 from recess 88. A pivot point opening 83 is surrounded with recess 86 (FIG. 22). Each of the two spaced rows of openings of the second group of openings 82 are arranged in an arcuate manner to provide greater flexibility in locating the carrier 15 to a desired location.

Recesses 84, 85 and 86 are designed to accommodate T-bushings, washers or screw plates for various screws or bolts as may be desired in the circumstances. No reversible insert 29 is needed with this embodiment. A locking plate, such as plate 50, may be used if desired. Hinge 70 includes standard flanges 90, 91 and flanges 90A that limit belt width with bar 74. The other aspects of clamp 10A include a sloping portion 92 of locking portion 76 that fits within opening and substantially fills 79 in a manner that is substantially identical to that of clamp 10.

With the exception of the discussion hereinabove clamp 10A is otherwise substantially identical to clamp 10.

As a general proposition, clamp 10A is wider than clamp 10 in order to be of use with spacer 15 as well as other devices. It is important to note that the relative size of clamps 10, 10A may vary depending upon the circumstances.

Figure 24:
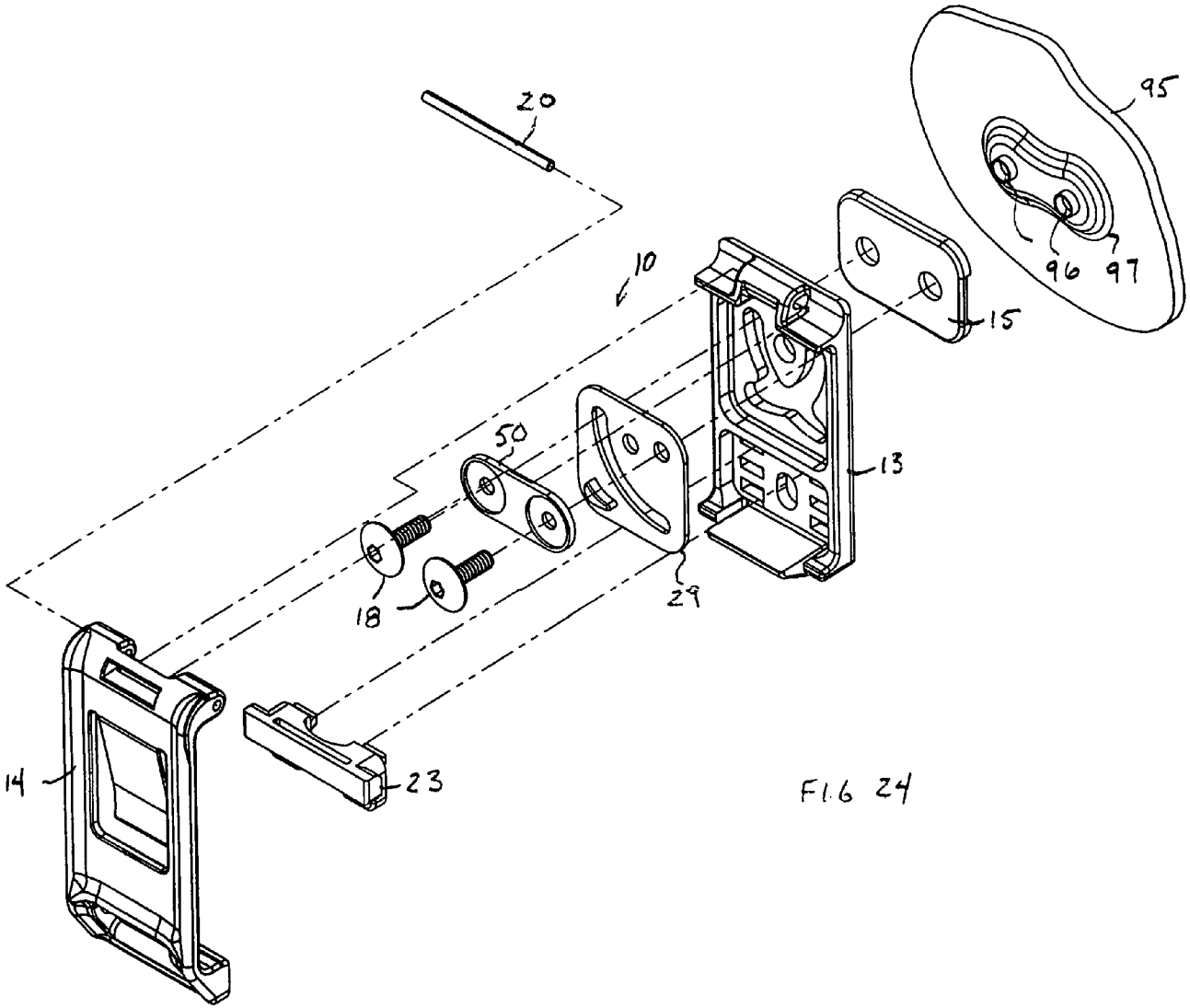
FIG. 24 is an exploded view of the components of the belt clamp and spacer in accord with the present invention.
Figure 26:
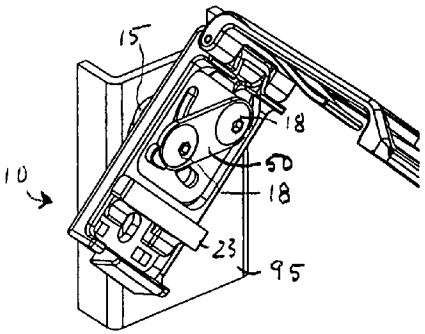
FIGS. 25-28 illustrate the assembly and use of the device in accord with the present invention.
Figure 28:
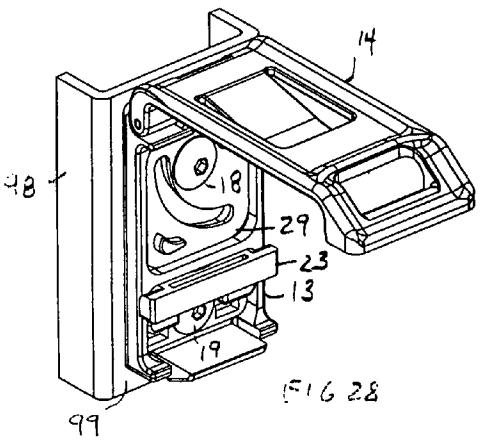
Figure 25:
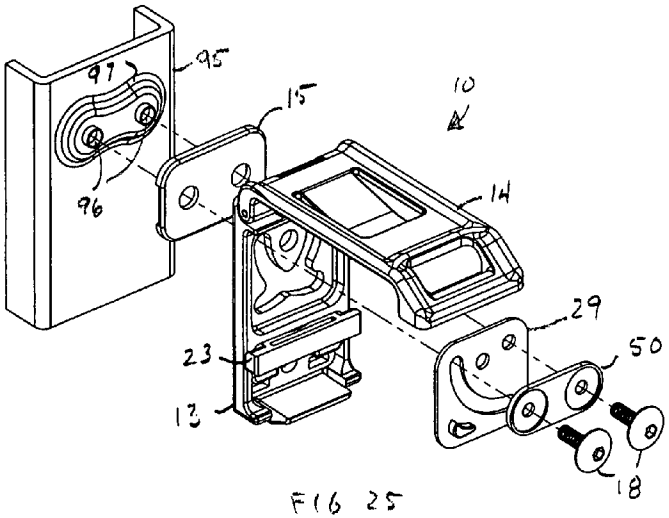
Figure 27:
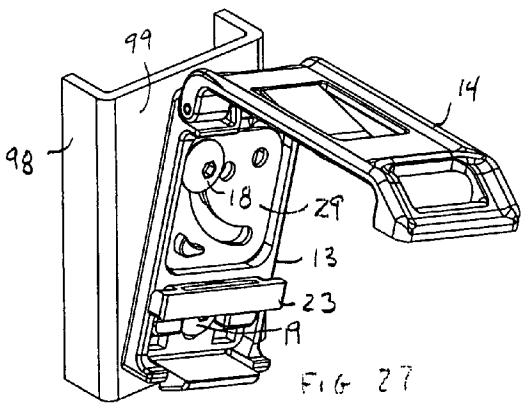

With respect to FIGS. 24-28, the clamp 10 is shown carrying a given article or device 95, 98 such as various firearm holsters. In FIGS. 24-26, device 95 has a curved surface 97 and two fastener openings 96. In this configuration, spacer 15 and plate 50 are used. In FIGS. 27-28, a device 98 (fastener openings not shown) with flat surface 99 is mounted; at a fixed angle, without spacer 15 and plate 50 (FIG. 27); or fixed vertically, without spacer 15 and plate 50, (FIG. 28). These two configurations employ elongate opening 28 and screw 19, both shown in FIG. 1, to eliminate pivoting movement.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. A carrier for supporting a holster for a law enforcement implement or the like on belts of varying widths, said carrier comprising:

a spacer member;

a base member having an upper extremity and a lower extremity, and an area with plural pairs of spaced opposing belt width adjustment slots extending into said base member with one pair of said plural pairs of slots being generally horizontally disposed and spaced vertically from another pair of said plural pairs of slots between said upper and lower extremities;

a pair of spaced removable fasteners for attaching said base member with said spacer member and both of said members to a holster;

a removable adjustment bar having unitary spaced prongs extending outwardly therefrom, said adjustment bar dimensioned to span a portion of said base member with said spaced prongs extending into selectable opposed pairs of said adjustment slots so as to permit selected changes in the vertical dimension between said adjustment bar and said upper extremity of said base member;

said spaced prongs being inserted into and engaged with said selected opposed pairs of said adjustment slots; said spaced prongs in said selected adjustment slots holding said spaced prongs in said selected adjustment slots, said adjustment bar location and said upper extremity of said base member defining opposing belt openings permitting a belt of a predetermined width less than said selected vertical dimension to extend through said belt openings and across said base member; and said spaced prongs being engaged in and by said selected adjustment slots without a fastener extending into or through said adjustment bar.

2. The carrier for supporting a holster for a law enforcement implement or the like on belts of varying widths as recited in claim 1, wherein said base member is pivotal about one of said removable fasteners.

3. The carrier for supporting a holster for a law enforcement implement or the like on belts of varying widths as recited in claim 1, wherein said adjustment bar and said adjustment slots are dimensioned such that said spaced prongs will only snugly fit into selected pairs of said adjustment slots that are along a line generally parallel with said upper extremity.

4. The carrier for supporting a holster for a law enforcement implement or the like on belts of varying widths as recited in claim 1, wherein each one of said belt openings is spaced from a generally horizontal row of a pair of said pairs of spaced adjustment slots.

5. The carrier for supporting a holster for a law enforcement implement or the like on belts of varying widths as recited in claim 1, wherein said adjustment bar has a longitudinal dimension greater than the distance between said adjustment slots in a pair of said pairs of slots to locate each end of said adjustment bar outwardly beyond an adjacent one of said adjustment slots.

6. The carrier for supporting a holster for a law enforcement implement or the like on belts of varying widths as recited in claim 5, wherein said longitudinal dimension of said adjustment bar extends generally parallel with a belt extending through said base member.

7. The carrier for supporting a law enforcement implement or the like on belts of varying widths as recited in claim 1, wherein each of said prongs includes a groove, and each said slot includes a lip defining a portion of said slot, respective said groove receiving respective said lip when said spaced prongs are inserted into said selected adjustment slots.

8. The carrier for supporting a law enforcement implement or the like on belts of varying widths as recited in claim 2, wherein each of said prongs includes a groove, and each said slot includes a lip defining a portion of said slot, respective said groove receiving respective said lip when said spaced prongs are inserted into said selected adjustment slots.

9. The carrier for supporting a law enforcement implement or the like on belts of varying widths as recited in claim 3, wherein each of said prongs includes a groove, and each said slot includes a lip defining a portion of said slot, respective said groove receiving respective said lip when said spaced prongs are inserted into said selected adjustment slots.

10. The carrier for supporting a law enforcement implement or the like on belts of varying widths as recited in claim 4, wherein each of said prongs includes a groove, and each said slot includes a lip defining a portion of said slot, respective said groove receiving respective said lip when said spaced prongs are inserted into said selected adjustment slots.

11. The carrier for supporting a law enforcement implement or the like on belts of varying widths as recited in claim 5, wherein each of said prongs includes a groove, and each said slot includes a lip defining a portion of said slot, respective said groove receiving respective said lip when said spaced prongs are inserted into said selected adjustment slots.

12. The carrier for supporting a law enforcement implement or the like on belts of varying widths as recited in claim 6, wherein each of said prongs includes a groove, and each said slot includes a lip defining a portion of said slot, respective said groove receiving respective said lip when said spaced prongs are inserted into said selected adjustment slots.

* * * * *